US005881710A

United States Patent [19]

Davis et al.

[11] Patent Number: 5,881,710

[45] Date of Patent: Mar. 16, 1999

[54] OVEN DOOR AND METHOD OF ASSEMBLY THEREFOR

[75] Inventors: Kenneth L. Davis, Vandalia; Keith Ray, Delaware, both of Ohio

[73] Assignee: Whirlpool Corporation, Benton Harbor, Mich.

[21] Appl. No.: 82,631

[22] Filed: May 21, 1998

Related U.S. Application Data

[60] Provisional application No. 60/053,721 Jul. 25, 1997.

[51] Int. Cl.[6] ..... F23M 7/00

[52] U.S. Cl. ..... 126/194; 126/200

[58] Field of Search ..... 126/194, 200, 126/190

[56] References Cited

U.S. PATENT DOCUMENTS

| | | | |
|---|---|---|---|
| 3,731,035 | 5/1973 | Jarvis et al. | 219/10 |
| 3,828,763 | 8/1974 | Wilson | 126/200 |
| 3,996,710 | 12/1976 | Nuss | 52/202 |
| 4,207,863 | 6/1980 | Drouin | 126/198 |
| 4,383,519 | 5/1983 | Katona | 126/190 |
| 4,390,767 | 6/1983 | Bucksbaum et al. | 219/10.55 |
| 4,606,324 | 8/1986 | Katona | 126/198 |
| 4,716,884 | 1/1988 | Bonaccorsi et al. | 126/198 |
| 4,817,858 | 4/1989 | Craver | 126/200 |
| 5,441,036 | 8/1995 | Mikalauskas, II et al. | 126/198 |

*Primary Examiner*—Carroll B. Dority
*Attorney, Agent, or Firm*—Robert O. Rice; Thomas A. Schwyn; Joel M. Van Winkle

[57] ABSTRACT

The invention is an oven door construction and assembly in which the oven door construction and its part count are greatly reduced and simplified as is the method of assembly in the door. The door is assembled by placing interior door elements on an inner liner and using the hinges of the door to compressively mount the interior door elements to the liner to thereby eliminate a great number of fasteners typically used in this type of door construction.

27 Claims, 9 Drawing Sheets

OVEN DOOR AND METHOD OF ASSEMBLY THEREFOR

This application claims the benefit of U.S. Provisional Appln. No. 60/053,721 filed Jul. 25, 1997.

BACKGROUND OF THE INVENTION

1. Field of the Invention

The invention is directed to an oven door, and more specifically to a simplified construction and assembly of an oven door.

2. Description of the Related Art

Ovens and their general construction are well known. Typically, an oven comprises a structural frame defining a baking chamber with an open side, which is closed by an oven door. Generally, ovens in the home appliance industry can be categorized as either a built-in or a stand-alone oven. The built-in ovens are designed to be installed within a kitchen cabinet and, therefore, do not have an outer cabinet or skin attached to the frame. The stand-alone ovens do have a cabinet for aesthetic reasons and typically include a cook top provided as part of the cabinet.

In the home appliance industry, traditional oven door constructions generally comprise multiple components, such as an inner liner, window, intermediate door members or elements, an outer panel, and a handle, all of which are secured to one another by a relatively large number of screws. Self-cleaning ovens, will also include a double pane window in the oven door. Examples of this type of oven door construction and assembly are shown in U.S. Pat. Nos. 4,606,324, 4,390,767, and 3,996,710.

A disadvantage of this type of oven door construction is that each of the oven door elements is connected to each other and there is a large number of screws used, resulting in an undesirably large number of parts to assemble and a relatively complex assembly method. It is desirable to simplify the door construction and its assembly, especially in the home appliance industry where price competition is very great and any reduction in parts numbers or assembly time can result in a competitive advantage.

SUMMARY OF THE INVENTION

The invention solves the problems associated with prior art cooking door constructions and assembly methods by providing an oven door having a significantly reduced number of parts and a simplified method of assembly. Specifically, the oven door according to the invention comprises an inner liner, which is adapted to seal the access opening of an oven frame, and at least one interior door element. A hinge is mounted to the inner liner to pivotally mount the door to the frame and to mount the interior door element to the inner liner.

Preferably, the hinge is shaped to compress the interior door element between the inner liner and the hinge to compressively mount the interior door element to the inner liner. Advantageously, the hinge can also be shaped to properly position the interior door element relative to the inner liner, so that when the hinge is mounted to the inner liner, the interior door element is properly positioned for assembly. There can be multiple inner door elements, all of which are held in place by the hinge.

The invention also provides a novel method for assembling an oven door comprising an inner liner, at least one interior door element, and a hinge. The method comprises placing the interior door element on the inner liner and securing the inner door element to the inner liner by mounting the hinge to the inner liner.

The mounting of the hinge to the inner liner can include compressively mounting the interior door element to the inner liner by compressing the interior door element between the hinge and the inner liner.

DESCRIPTION OF THE PREFERRED EMBODIMENT

Figure 1:
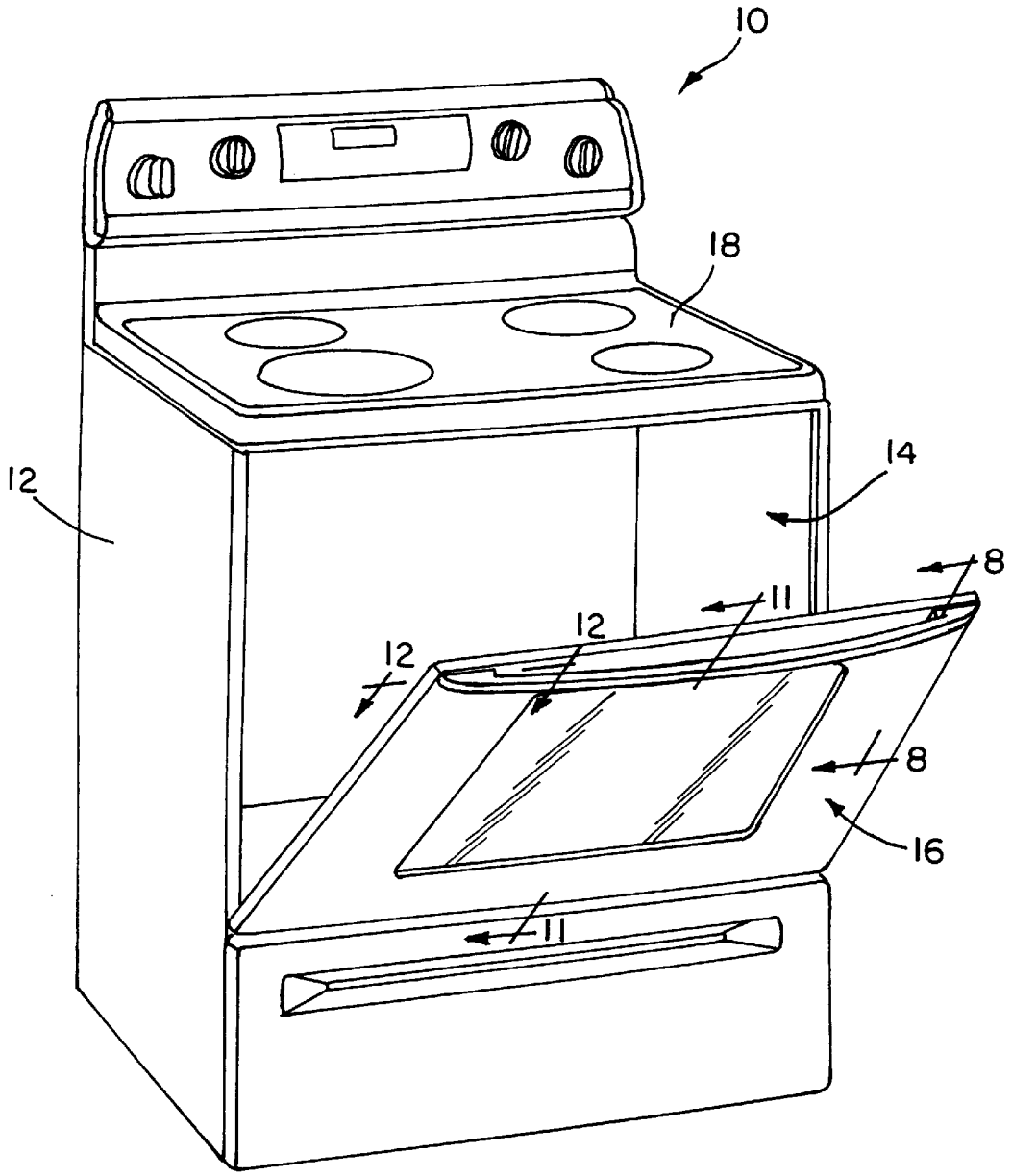
FIG. 1 is a perspective view of a stand-alone oven incorporating an oven door according to the invention.

FIG. 1 illustrates an oven 10 illustrating the environment of the invention. The oven 10 comprises a cabinet 12 mounted to a structural frame. The cabinet defines a baking chamber 14. A door 16, according to the invention, is mounted to the cabinet 12 and is rotatable between two positions for providing access to the baking chamber 14 or closing the baking chamber 14. The oven 10 is illustrated as a stand-alone model with a cook top 18. However, it should be understood that the invention is not limited to a stand-alone oven as illustrated, but is applicable to any type of oven.

Figure 2:
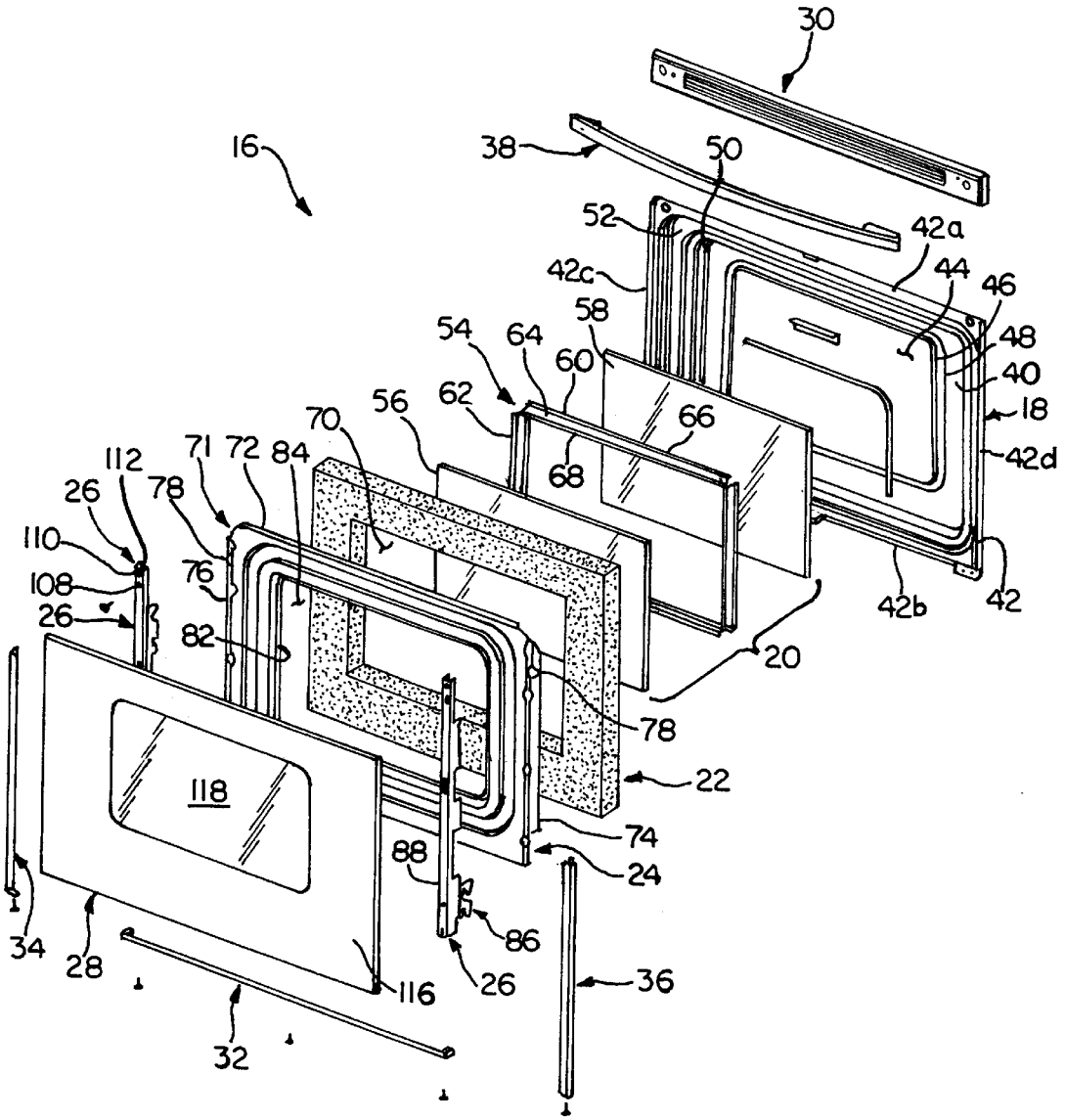
FIG. 2 is an exploded view of the oven door of FIG. 1.

FIG. 2 is an exploded view of the oven door 16 and illustrates the various components of the door 16. The major components of the door 16 include interior door elements: inner liner 18, window assembly 20, insulation layer 22, and insulation retainer 24; hinges 26; front panel 28; trim elements: top trim 30, bottom trim 32, left side trim 34, right side trim 36, and handle 38.

The inner liner 18 is generally rectangular and has a multilevel, pan-shaped base 40 (FIG. 8) from which extends a peripheral flange 42 having a top portion 42*a*, bottom portion 42*b*, left side portion 42*c* and right side portion 42*d*. A window opening 44 is defined by a channel 46, extending from a first ledge 48. The inner liner 18 further comprises a second ledge 50 and a third ledge 52. The various ledges define the multilevel appearance of the inner liner 18. Each ledge also defines an effective recess whose function will be described with reference to the other door components.

The window assembly 20 comprises a window frame 54 that mounts opposing windows or panes of glass 56 and 58. Preferably, the window frame has a generally u-shaped cross section comprising opposed side walls 60 and 62 connected by a web 64. Spring flanges 66 and 68 extend outwardly from the terminal ends of the side walls 60 and 62, respectively. The spring flanges define an opening size that is slightly smaller than the perimeter of the windows 56 and 58. To thereby provide for a snap-fit mounting of the windows within the spring flanges upon assembly. Once the windows are snapped behind the spring flanges, the windows will rest on their associated side wall.

The insulation layer 22 can be of any suitable insulating material and is generally rectangular in shape having a central opening 70 that is sized to fit around the window frame 54. The outer perimeter of the insulation layer is sized to rest on the second ledge 50 and fill in the space between the inner liner and the window assembly.

The insulation retainer 24 comprises a generally rectangular frame 71 having a peripheral flange 72. A pair of positioning flanges 74 and 76 extend outwardly from the vertical sides of the peripheral flange 72. The positioning flanges 74 and 76 each have a guide embossment 78, respectively. Also, the positioning flanges 74 and 76 do not extend entirely down to the bottom of the frame to aid in the mounting of the hinges as described below. The frame 71 comprises an inner peripheral lip 82, which defines window 84.

Figure 3:
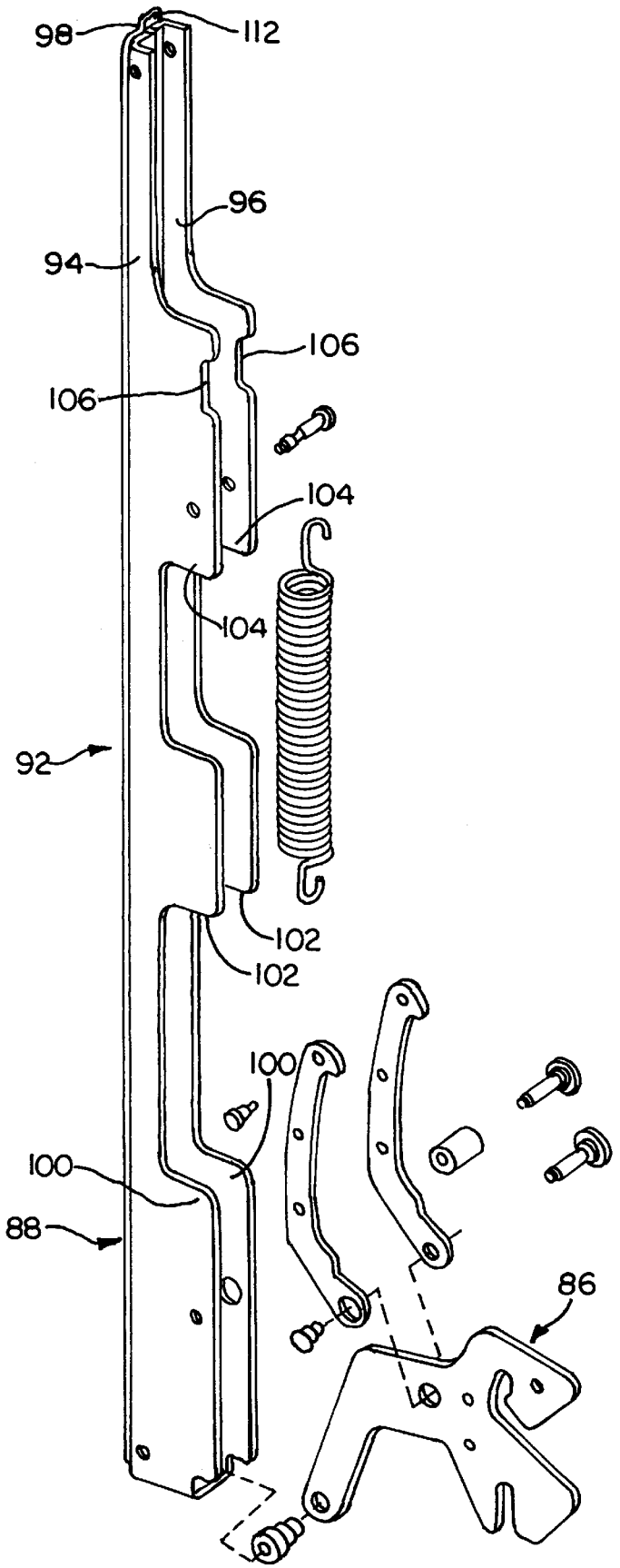
FIG. 3 is an exploded view of the hinge shown in FIG. 2.

Referring to FIGS. 2 and 3, the hinges 26 are substantially identical and comprise a first hinge arm 86, pivotally mounted to a second hinge arm 88. The first hinge arm 86 is a hanger 90, which is adapted to be mounted to the cabinet 12 of the oven 10. The second hinge arm 88 is an elongated u-shaped channel member 92 comprising opposing side walls 94 and 96 connected by a web 98. The side walls include multiple tabs 100, 102, and 104. The tabs 104 has formed therein a positioning notch 106. A bumper opening 108 and an alignment opening 110 (FIG. 8) are formed in the web 98 of the elongated channel member 92. The mounting tab 112 extends from the upper end of the elongated channel member 92. Two screw holes (not shown) are formed in the lower end of the elongated channel member 92.

The front panel 28 is preferably a glass panel having a substantially opaque outer area 116 and a substantially transparent inner window as in 118. Although the outer panel 28 is illustrated as a glass panel, any suitable panel for covering the outer surface of the door is satisfactory. The particular features or construction of the outer panel are not pertinent to the invention.

The assembly of the oven door will now be described in greater detail. FIGS. 4–10 illustrate the assembly of the oven door. The description of the assembly is best started with reference to FIG. 4.

Figure 4:
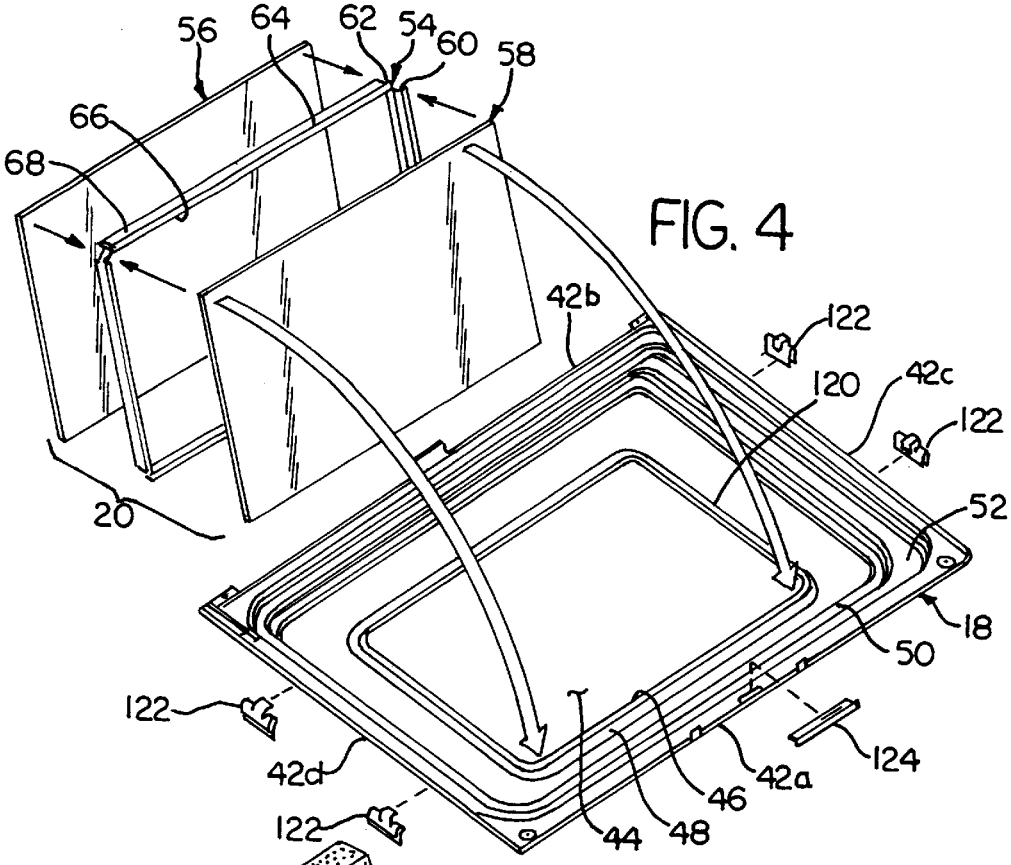
FIG. 4 is a perspective view illustrating the first step of assembling the oven door of FIG. 2 wherein the window and other components of the oven door are assembled with the inner liner.

As shown in FIG. 4, initially to assemble the oven door 16, a gasket 120 is placed within the channel 46 of the inner liner 18. Door clips 122 are then clipped onto the peripheral flange 42 of the inner liner. A latch bracket 124 is fastened to the upper portion of the peripheral flange 42. The fixing or mounting of the gasket 120, door clips 122 and latch bracket 124 can occur during the assembly of the entire door or as part of a sub-assembly in putting together the inner liner 18. After the gasket 120, door clips 122, and latch bracket 124 are mounted to the inner liner 18, the inner liner is ready to receive the window assembly 20.

Figure 11:
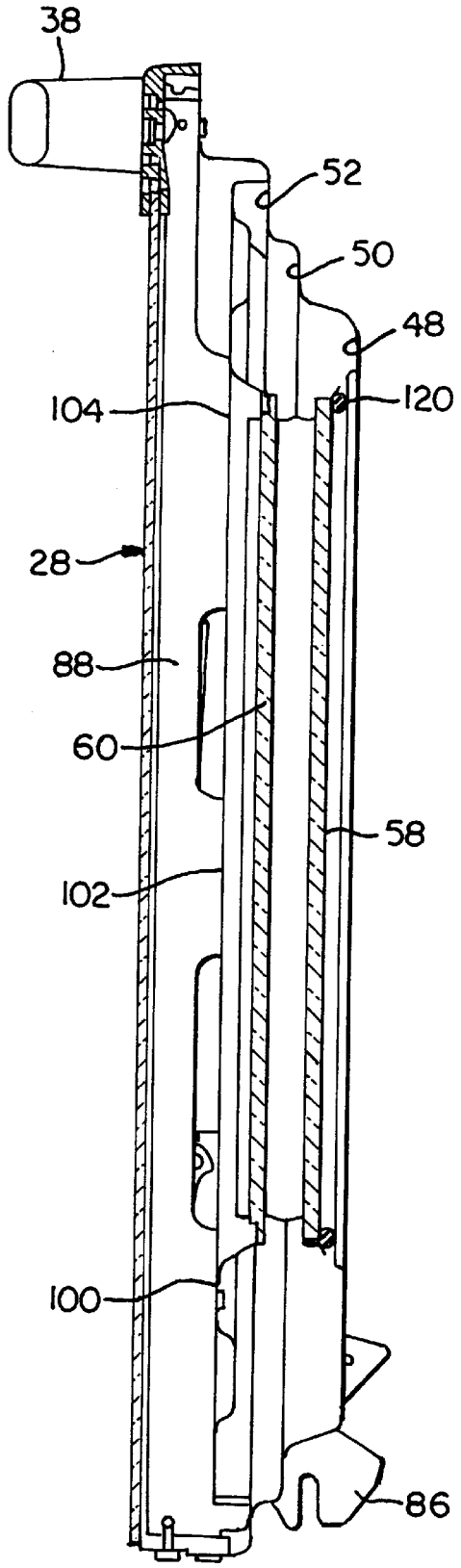
FIG. 11 is a sectional view partially broken away taken along line 11—11 of FIG. 1.

The window assembly 20 is formed by pressing the windows 56 and 58 past the spring flanges 66 and 68, respectively, until they rest against the side walls 60, 62 respectively. In this position, the windows 56 and 58 are retained by the spring flanges 66, 68 against the side walls 60 and 62. The assembly of the window assembly can also be pre-assembled prior to assembling the oven door or occur during the assembly of the oven door. Once the window assembly is assembled, it is positioned on the inner liner so that the window 58 is generally centered about the window 44 of the inner liner and abuts the gasket 120 (FIGS. 11 and 12) to seal the window assembly 20 with respect to the inner liner 18.

Figure 5:
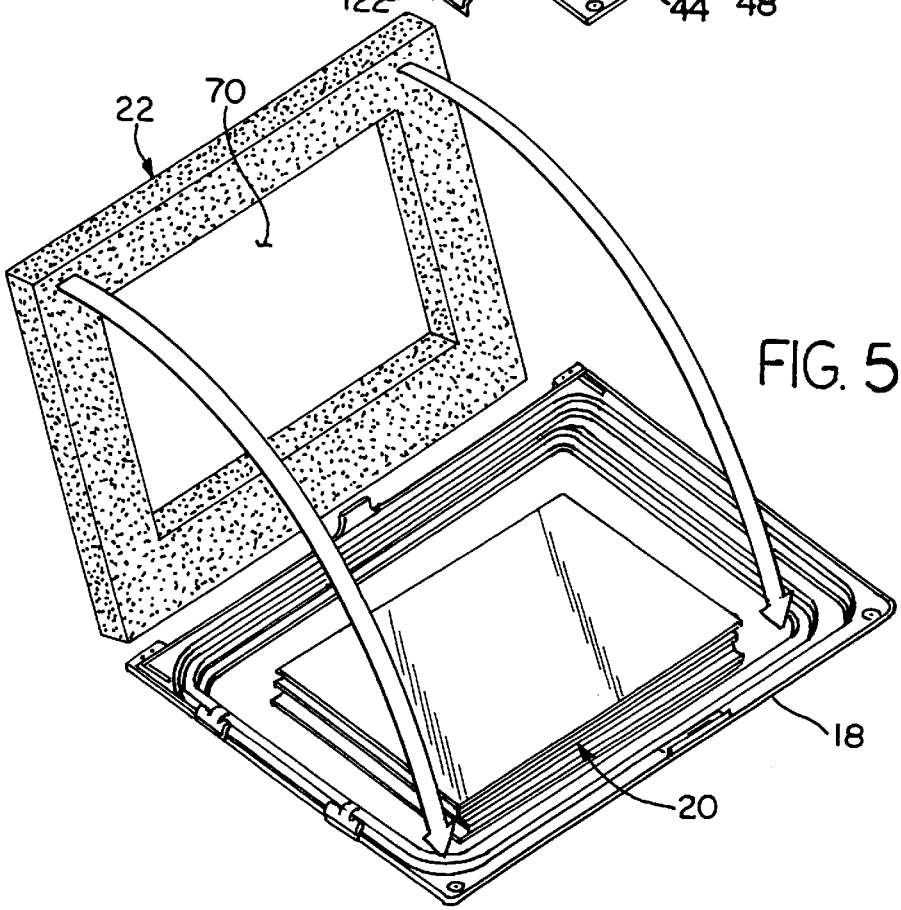
FIG. 5 is a perspective view illustrating the addition of an insulation layer to the partial assembly of FIG. 4.
Figure 7:
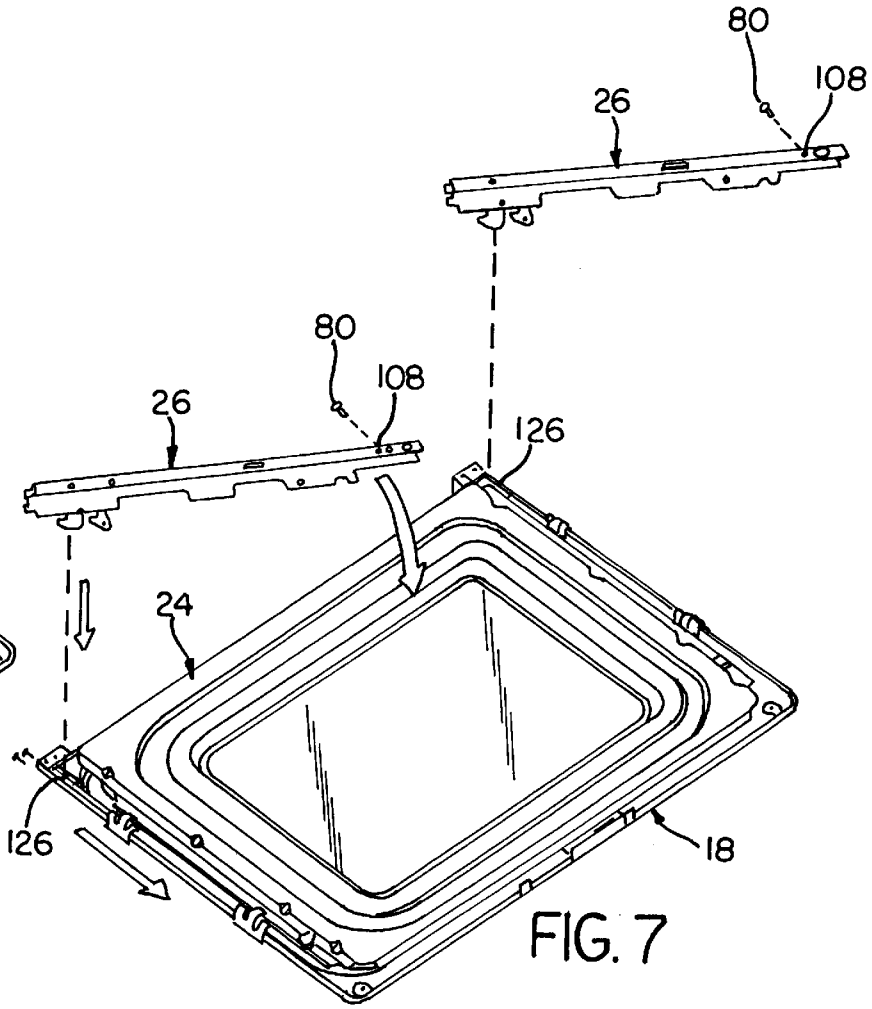
FIG. 7 is a perspective view illustrating the addition of hinges to the partial assembly shown in FIG. 6.

Referring to FIG. 5, after the window assembly is positioned on the inner liner, the insulation layer 22 is then positioned on the inner liner so the window assembly 20 is received within the window opening 70 of the insulation layer 22. The insulation layer 22 generally rests on the second ledge 50 (FIG. 12) of the inner liner and fills in the space between the inner liner and the window assembly, including filling in and resting on the first ledge 48. Preferably, the insulation layer does not extend onto the third ledge 52. However, given the variation in insulation sizes and the ability of the insulation to stretch, it is possible for the insulation layer 22 to spread onto the third ledge 52.

Figure 6:
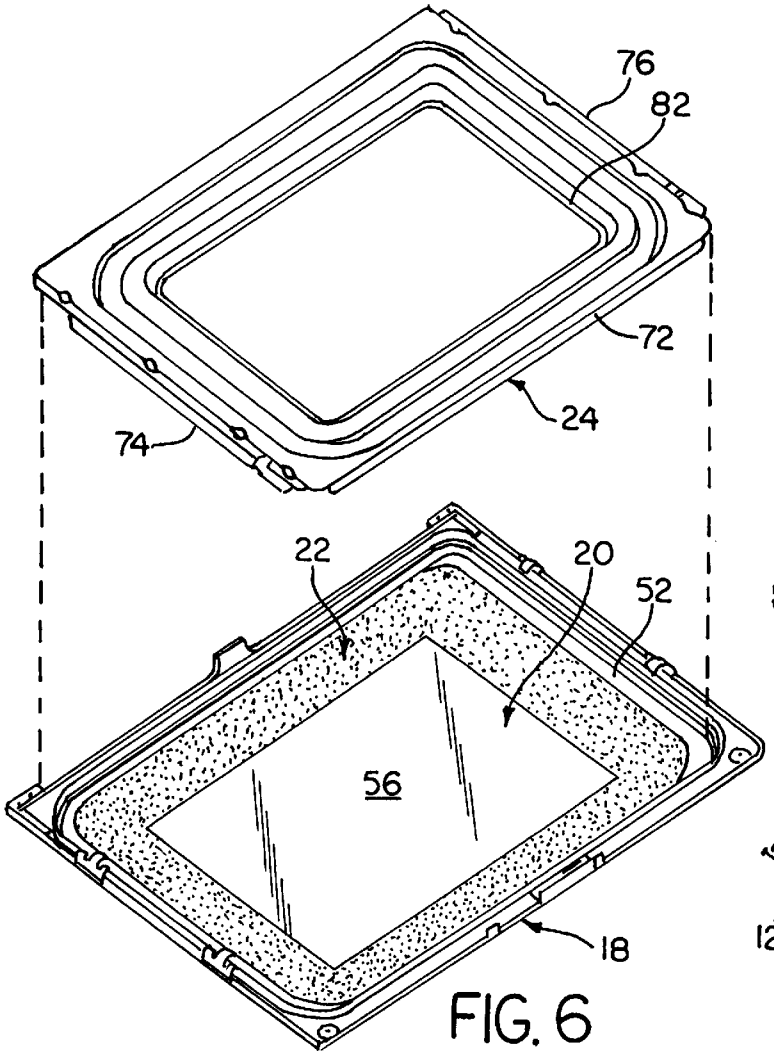
FIG. 6 is a perspective view illustrating the addition of an insulation retainer to the partial assembly shown in FIG. 5.
Figure 12:
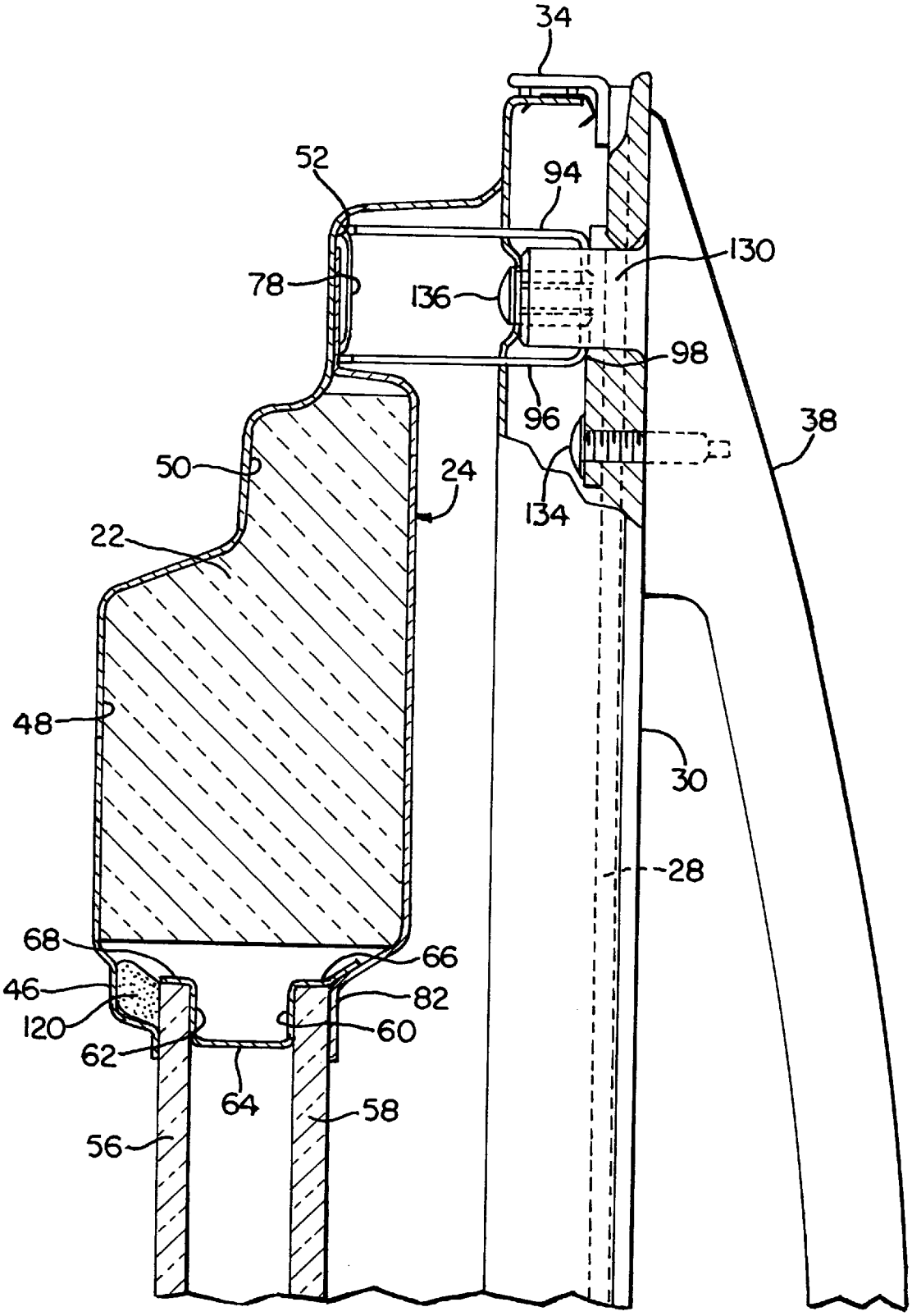
FIG. 12 is a sectional view taken along line 12—12 of FIG. 1.

Referring to FIGS. 6 and 12, after the insulation layer 22 is positioned on the inner liner, the insulation retainer 24 is positioned on the inner liner 18. When the insulation retainer 24 is placed on the inner liner 18, the positioning flanges 74 and 76 of the insulation retainer 24 rest upon the third ledge 52 and the peripheral flange 72 rests on or is adjacent to the third ledge 52. Also, the peripheral lip 82 passes through the window opening 70 of the insulation layer 22 and rests on the window 56 of the window assembly 20. The peripheral lip 82 cooperates with the spring flanges on the window assembly to align the window assembly relative to the insulation retainer. In general, the insulation layer is then captured between the peripheral flange 72 and the peripheral lip 82 of the insulation retainer to prevent the insulation from being visible through aligned windows and window openings of the door.

Referring to FIGS. 7, 8, 11 and 12, the hinges 26 are assembled to the inner liner 18 after the insulation retainer 24 is positioned. Bumpers 80 are mounted to the hinges 26 by inserting them into the opening 108. To install the hinges 26, the hangers are first inserted into a hinge opening 126 provided at the lower comers of the inner liner. The hinge 26 is then rotated toward the inner liner bringing the upper end of the hinges 26 toward the upper portion of the peripheral flange 42. The hinges 26 are rotated toward the inner liner 18 until the tabs 100, 102 and 104 abut the positioning flanges 74 and 76. It is at this point where the insulation retainer 24 and the hinges 26 are adjusted relative to each other to insure that the guide embossments 78 are received within the positioning notch 106 on the tab 104 to properly align the insulation retainer 24 with the hinges 26. The hinges 26 are then slid forwardly until the tab 112 is received within a guide slot 128 in the upper portion 42*a* of the peripheral flange 42. The insertion of the hinge into the hinge opening 126, the receipt of the guide embossments 78 into the positioning notches 106, and the insertion of the tab 112 into the tab slot 128 provide for aligning the hinges and therefore the insulation retainer relative to the inner liner. The alignment of the insulation retainer relative to the inner liner also properly aligns the insulation and the window assembly relative to the inner liner.

In addition to properly aligning at least the insulation retainer 24 relative to the inner liner 18, the mounting of the hinges also compressively retains at least the insulation retainer against the inner liner 18. This occurs during the rotation of the hinges toward the inner liner. As the tabs 100, 102, and 104 contact the positioning flanges 74 and 76, the mounting tab 112 extending from the upper end of the elongated channel member 92 still lies above the tab slot 128 in the inner liner. The elongated channel member 92 must be pressed toward the inner liner 18 to align the tab 112 with the tab slot 128. As the elongated channel member 92 is pressed against the positioning flange 74, the positioning flange is compressed between the hinge 26 and the inner liner 18 to compressively mount the insulation retainer to the inner liner.

Figure 8:
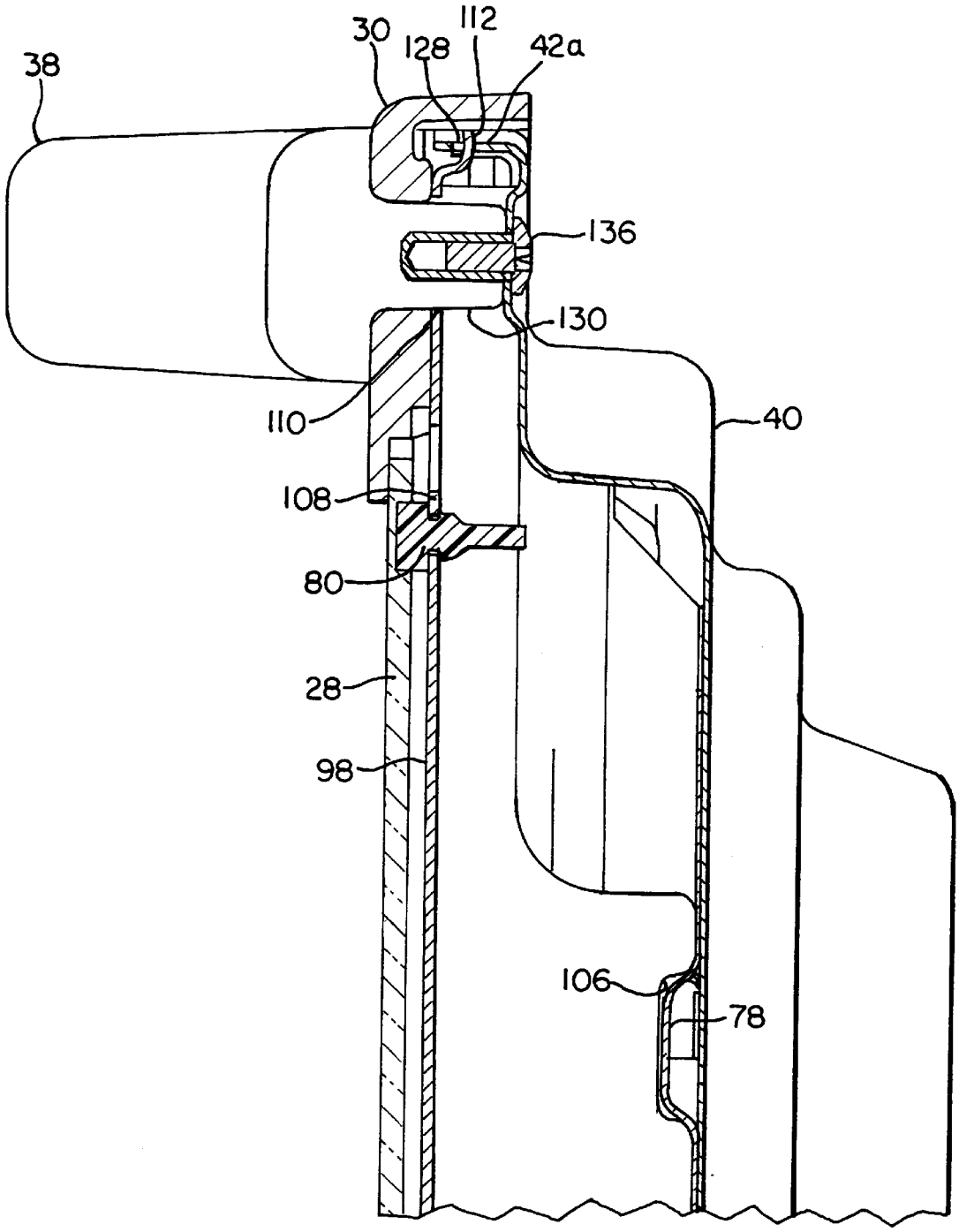
FIG. 8 is a sectional view of the fully assembled door of FIG. 1, illustrating the cooperation between the locator embossment on the insulation retainer and the locator notch on the hinge.
Figure 9:
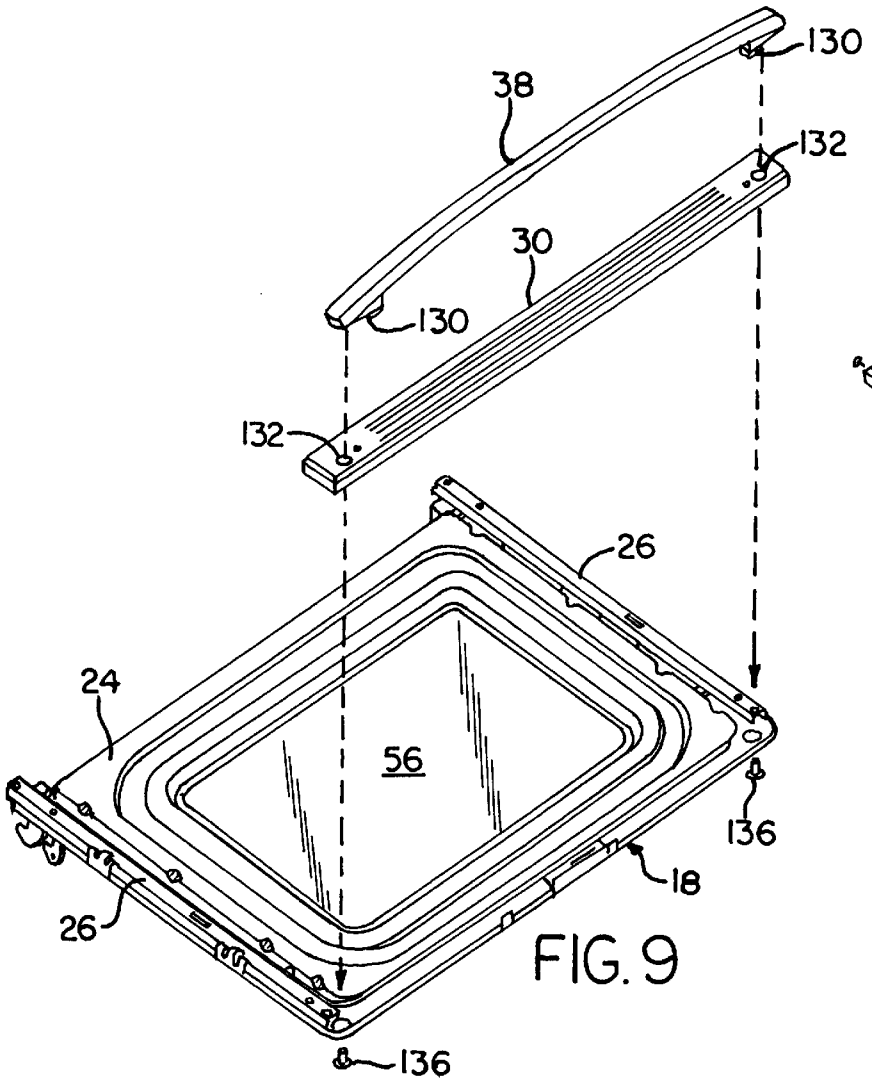
FIG. 9 is a perspective view illustrating the addition of the door handle to the partial assembly shown in FIG. 7.

Referring to FIGS. 8, 9 and 12, after the hinges have been mounted to the inner liner, the top trim 30 is then connected to the handle 38 by inserting mounting embossments 130 on the handle 38 into embossment openings 132 on the top trim 30. Screws 134 are then passed through the back side of the top trim 30 and into the handle to secure the handle 38 to the top trim 30 without the screws being visible to the user.

The assembled top trim 30 and handle 38 is then mounted to the hinges 26 by inserting the mounting embossments 130 into the alignment openings 110. Screws 136 are then passed through openings in the inner liner and screwed into the mounting embossments 130 of the handle. The use of the screw passing through the inner liner and into the handle further provides for compressively mounting the insulation retainer 24 to the inner liner 18. That is, as the screw is tightened, the handle 130 is drawn against the hinges 26 to further compressively retain the insulation retainer to the inner liner. It is within the scope of the invention to use alone, or in combination, the mounting tabs 112 with corresponding tab slots 128 and/or the mounting of the handle to the hinge to compressively retain the insulation retainer 24 to the inner liner 18.

Figure 10:
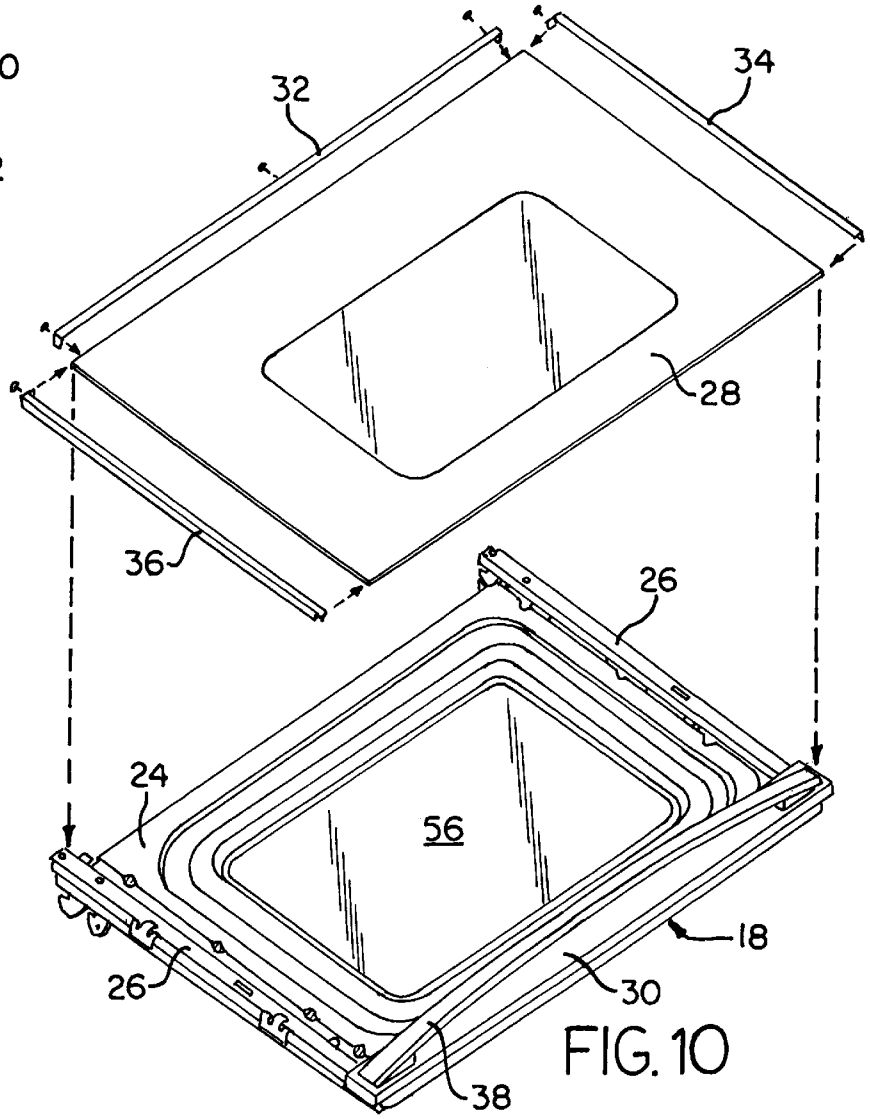
FIG. 10 is a perspective view illustrating the addition of the front glass panels and exterior trim pieces to the partial assembly shown in FIG. 9.

Referring to FIG. 10, once the handle and top trim are mounted to the hinges 26, one of the side trims 34 and 36, along with the bottom trim 32 are mounted to the inner liner. The side trims are mounted to the inner liner by inserting the upper end into the top trim 30 and fastening the lower end to the bottom portion 42*a* of the peripheral flange 42 by a suitable fastener such as a screw. Similarly, the bottom trim 32 is mounted to the bottom portion of the peripheral flange 42 by a suitable fastener such as a screw. The top trim 30, one of the side trims 34 and 36, and the bottom trim 32 all define a channel for receiving the front panel 28 when the trim pieces are mounted to the inner liner 18. The trim pieces can be mounted in any suitable order that permits the installation of the front panel. Preferably, the trim pieces are assembled by first installing the bottom trim 32 by fastening its middle portion to the lower portion 42*b* of the peripheral lip 42 of the insulation retainer. The front panel is then slid between the top trim and the bottom trim. Thereafter, the sides trim pieces are mounted.

As can be seen by the description of the door construction and its assembly, the door construction and assembly according to the invention provide a simplified door construction and assembly that greatly reduces the number of parts, especially the number of fasteners, needed to assemble the door along with reducing the complexity and time for assembling the door. A reduced part count in the simplified assembly method provides the invention with a competitive advantage over previous door constructions, which is very valuable in a highly competitive market such as the home appliance industry.

We claim:

1. A door for an oven comprising a cabinet, defining a cooking chamber with an access opening, which is closed by the door, the door comprises:

an inner liner adapted to seal the access opening when the door closes the access opening;

at least one interior door element; and a hinge mounted to the inner liner to pivotally mount the door to the cabinet and to mount the at least one interior door element to the inner liner.

2. A door as claimed in claim 1, wherein the hinge is shaped to compress the at least one interior door element between the inner liner and the hinge to compressivley mount the at least one interior door element to the inner liner.

3. A door as claimed in claim 2, wherein the hinge is shaped to position the at least one interior door element relative to the inner liner such that when the hinge is mounted to the inner liner, the at least one interior door element is properly positioned for assembly.

4. A door as claimed in claim 3, wherein the hinge comprises a first hinge plate adapted to connect the hinge to the cabinet and a second hinge plate adapted to mount to the inner liner and compressively mount the at least one interior door element to the inner liner.

5. A door as claimed in claims 4, wherein the inner liner comprises a generally rectangular rear wall having a peripheral flange with an upper portion, lower portion, and opposing side portions connecting the upper and lower portions, providing the inner liner with rectangular pan-like appearance.

6. A door as claimed in claim 5, wherein the second hinge plate extends between and is fastened to the inner liner near the upper portion and the lower portion of the peripheral flange to compressively mount the at least one inner door element between the hinge and the inner liner.

7. A door as claimed in claim 6, and further comprising a handle that is fastened to the inner liner by a screw passing through the inner liner, hinge, and into the handle to draw together the inner liner, hinge and handle to compressively mount the interior door element between the hinge and the inner liner.

8. A door as claimed in claim 7, wherein the second hinge plate is an elongated u-shaped channel having opposing sidewalls connected by a bight portion having an opening, the handle has an embossment sized to be received within the opening of the bight portion, and wherein the second hinge plate is positioned against the inner liner so that the bight portion is not contacting the inner liner and the embossment passes through the opening of the bight portion and the screw passes through the inner liner, into the channel and into the embossment to draw the handle toward the inner liner as the screw is tightened to draw the second hinge plate against the at least one interior door element to compressively mount the at least one interior door element between the hinge and the inner liner.

9. A door as claimed in claim 1, wherein the inner liner comprises a generally rectangular rear wall having a peripheral flange with an upper portion, lower portion, and opposing side portions connecting the upper and lower portions, providing the inner liner with rectangular pan-like appearance.

10. A door as claimed in claim 9, wherein the inner liner has a first hinge opening in the rear wall near the lower portion and a second hinge opening in the upper portion, the first hinge plate is a hanger passing through the first hinge opening and adapted to mount to the cabinet, and the second hinge plate is an elongated u-shaped channel comprising opposing sidewalls connected by a bight portion and a lower end mounted to the lower portion and an upper end having a tab slidably received within the second hinge opening to mount compressively mount the at least one interior door element between the hinge and the inner liner.

11. A door as claimed in claim 10, wherein the elongated channel has an opening near the upper end and further comprising a handle having an embossment sized to be received within the channel opening wherein the second hinge plate is positioned against the inner liner so that the bight portion is not contacting the inner liner and the embossment passes through the opening and a screw passes through the inner liner, into the channel and into the embossment to draw the handle toward the inner liner as the screw is tightened to draw the second hinge plate against the at least one interior door element to compressively mount the at least one interior door element between the hinge and the inner liner.

12. A door as claimed in claim 1, wherein the hinge is shaped to position the at least one interior door element relative to the inner liner such that when the hinge is mounted to the inner liner, the at least one interior door element is properly positioned for assembly.

13. A door as claimed in claim 12, wherein the hinge comprises a first hinge plate adapted to connect the hinge to the cabinet and a second hinge plate adapted to mount to the inner liner and one of the second hinge plate and the at least one interior door element having a keyhole and the other of the at least second hinge plate and the at least one interior door element having a complementary key whereby when the key is received within the keyhole, the at least one interior door element is properly positioned relative to the inner liner.

14. A door as claimed in claim 13, wherein the at least one interior door element comprises an insulation retainer.

15. A door as claimed in claim 14, wherein the at least one interior door element further comprises at least one window and an insulation layer surrounding the window, the window and insulation layer are disposed between the insulation retainer and the inner liner.

16. A door as claimed in claim 15, wherein the inner liner has a first ledge defining a window opening and the periphery of the window is place on the ledge to position the window relative to the inner liner.

17. A door as claimed in claim 16, wherein the inner liner has a second ledge on which the insulation layer is placed to position the insulation layer relative to the inner liner.

18. A method for assembling an oven door comprising an inner liner, at least one interior door element, and a hinge, the method comprising:

placing the at least one interior door element on the inner liner, and securing the at least one interior door element to the inner liner by mounting the hinge to the inner liner.

19. A method as claimed in claim 18, wherein the step of mounting the hinge to the inner liner includes compressively mounting the at least one interior door element to the inner liner by compressing the at least one interior door element between the hinge and the inner liner.

20. A method as claimed in claim 19, wherein the inner liner comprises a generally rectangular rear wall having a peripheral flange with an upper portion, lower portion, and opposing side portions connecting the upper and lower portions, providing the inner liner with rectangular pan-like appearance, the hinge comprises a first hinge plate adapted to connect the hinge to the cabinet and a second hinge plate mounted to the inner liner, and wherein the step of compressively mounting the at least one interior door element to the inner liner includes compressing the at least one interior door element between the second hinge plate and the inner liner.

21. A method as claimed in claim 20, wherein the inner liner has a first hinge opening in the rear wall near the lower portion and a second hinge opening in the upper portion, the first hinge portion is a hanger and the second hinge plate is an elongated u-shaped channel comprising opposing sidewalls connected by a bight portion and having a lower end and an upper end, and wherein the step of mounting the hinge to the inner liner includes inserting the hanger through the first hinge opening, pressing the elongated channel against the at least one interior door element to compress the at least one interior door element between the elongated channel and the inner liner, and fastening the lower end and upper end to the lower portion and upper portion, respectively.

22. A method as claimed in claim 21, wherein the upper end comprises a tab and the step of fastening the upper end to the upper portion includes the step of sliding the tab into the second hinge opening.

23. A method as claimed in claim 22, wherein the at least one interior door element has an embossment and the elongated channel has a complementary notch and the method of securing the at least one interior door element further comprises the step of properly aligning the at least one interior door element relative to the inner liner by positioning the at least one interior door element such that the embossment is received within the notch when the elongated channel is mounted to the inner liner.

24. A method as claimed in claim 21, wherein the door further comprises a handle and the step of fastening the upper end of the elongated channel includes the step of positioning the handle such that the elongated channel is between the handle and the inner liner and passing a screw through the inner liner and elongated and into the handle whereby the tightening of the screw presses the handle toward the inner liner to compressively mount the at least one interior door element between the elongated channel and the inner liner.

25. A method as claimed in claim 24, wherein the handle has an embossment and the elongated channel has an opening and the step of the fastening the upper end of the elongated channel includes the step of positioning the handle relative to the hinge by receiving the handle embossment within the elongated channel opening and the step of screwing the screw into the handle includes screwing the screw into the embossment.

26. A method as claimed in claim 18, wherein the step of securing the at least one interior door element includes the step of positioning the at least one interior door element relative to the inner liner for proper assembly by the mounting of the hinge.

27. A method as claimed in claim 25, wherein the hinge comprises a first hinge plate adapted to connect the hinge to the cabinet and a second hinge plate adapted to mount to the inner liner and one of the second hinge plate and the at least one interior door element having an embossment and the other of the at least second hinge plate and the at least one interior door element having a complementary notch, and the step of properly positioning the at least one door element includes the step of receiving the embossment within the notch.

* * * * *